US005544890A

United States Patent [19]

Shaw et al.

[11] Patent Number: 5,544,890

[45] Date of Patent: Aug. 13, 1996

[54] GOLF BALL DIMPLE PATTERNS

[75] Inventors: Michael Shaw, Wakefield; Gary W. Slater, Castleford, both of England

[73] Assignee: Dunlop Limited, London, England

[21] Appl. No.: 479,549

[22] Filed: Jun. 7, 1995

Related U.S. Application Data

[63] Continuation of Ser. No. 361,015, Dec. 21, 1994, abandoned, which is a continuation of Ser. No. 226,377, Apr. 12, 1994, abandoned, which is a continuation of Ser. No. 666,884, Mar. 8, 1991, abandoned.

[30] Foreign Application Priority Data

Mar. 29, 1990 [GB] United Kingdom ..... 9007092

[51] Int. Cl.[6] ..... A63B 37/14

[52] U.S. Cl. ..... 473/383

[58] Field of Search ..... 273/62 R, 232

[56] References Cited

U.S. PATENT DOCUMENTS

| | | | |
|---|---|---|---|
| 4,560,168 | 12/1985 | Aoyama | 273/232 |
| 4,720,111 | 1/1988 | Yamada | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,948,143 | 8/1990 | Aoyama | 273/232 |
| 4,974,855 | 12/1990 | Morell | 273/232 |
| 5,009,428 | 4/1991 | Yamagishi et al. | 273/232 |
| 5,078,402 | 1/1992 | Oka | 273/232 |

FOREIGN PATENT DOCUMENTS

| | | | |
|---|---|---|---|
| 2234179 | 1/1991 | United Kingdom | 273/232 |

*Primary Examiner*—Steven B. Wong
*Attorney, Agent, or Firm*—Lorusso & Loud

[57] ABSTRACT

A dimpled golf ball is provided with a regular repeating dimple pattern by projecting on to the surface of the ball the edges of a regular octahedron, thereby forming eight equilateral triangles on the surface. Each of the eight equilateral triangles can then be divided into sub-triangles so that there are four, six, seven or nine dimple-free great circles on the ball.

19 Claims, 7 Drawing Sheets

GOLF BALL DIMPLE PATTERNS

This is a continuation of U.S. Ser. No. 08/361,015, filed Dec. 21, 1994, now abandoned which was a continuation of U.S. Ser. No. 08/226,377, filed Apr. 12, 1994, now abandoned which was a continuation of U.S. Ser. No. 07/666,884, filed Mar. 08, 1991, now abandoned.

This invention relates to golf ball dimple patterns and in particular to dimple patterns which permit a variable number of dimple-free regions extending along great circles of the ball.

Golf balls are generally made in a two-part mould. As a result, there will be at least one dimple-free region, corresponding to the mould parting line, around a great circle of the moulded ball.

Many proposals have been made to improve the aerodynamic behaviour of a golf ball by providing more than one such dimple-free great circle on the ball. In order to produce the symmetrical surface properties of the ball (which are to some degree prescribed by the rules of the game of golf), such dimple-free great circles are generally achieved by projecting on to the spherical surface of the ball the edges of a regular polyhedron and then dividing each face of the polyhedron along a great circle of the ball.

Hitherto, it has only been shown to achieve a single, fixed number of great circles from any one polyhedral projection.

We have now found that it is possible to achieve a variable number of great circles by varying the manner of division of the faces of a single polyhedron: in this instance a regular octahedron. As is well known, a regular octahedron comprises eight faces, each of which is an equilateral triangle.

Accordingly, the present invention provides a dimpled golf ball having in its spherical surface a variable number of dimple-free great circles, the spherical surface being first divided into eight equilateral triangles by projecting thereon the edges of a regular octahedron and each of the said eight equilateral triangles being sub-divided, whereby the number of dimple-free great circles on the ball is four, six, seven or nine.

In a first preferred embodiment of the invention, each of the eight equilateral triangles of the octahedron is sub-divided into three isosceles sub-triangles and one equilateral sub-triangle by joining centre-side to centre-side, making thirty-two triangles in all and creating four dimple-free great circles on the surface of the ball.

In a second preferred embodiment, the eight equilateral triangles are again sub-divided as described with respect to the first embodiment, with additional dimple-free great circles provided along each edge of the octahedron, making forty triangles in all and creating seven dimple-free great circles on the surface of the ball.

In a third preferred embodiment, each of the eight equilateral triangles of the octahedron is sub-divided into three pairs of sub-triangles by joining centre-side to opposite apex, making forty-eight triangles in all and creating six dimple-free great circles on the surface of the ball.

In a fourth preferred embodiment, the eight equilateral triangles are again sub-divided as described with respect to the third embodiment, with additional dimple-free great circles provided along each edge of the octahedron, making fifty-six triangles in all and creating nine dimple-free great circles on the surface of the ball.

Golf balls of the present invention are conveniently made by moulding.

In this case, the parting line of the mould used to make the ball may correspond to one of the four, six, seven or nine dimple-free great circles.

The dimples in any one triangle or sub-triangle may be of uniform dimensions and/or configuration.

Alternatively, the dimples in any one triangle or sub-triangle may be of different dimensions and/or configuration.

Preferably, at least 60% of the surface area of the ball is provided with dimples.

Golf balls according to the present invention may suitably have from about 200 to 600 dimples.

Preferably, the dimple pattern is symmetrical relative to any one or more of the dimple-free great circles.

The present invention is applicable to golf balls of all types, for example solid balls, wound-core balls; two-piece or three-piece balls.

The present invention will be illustrated, merely by way of example, in the following description and with reference to the accompanying drawings.

In the drawings (wherein like numerals denote like parts):

Figure 1:
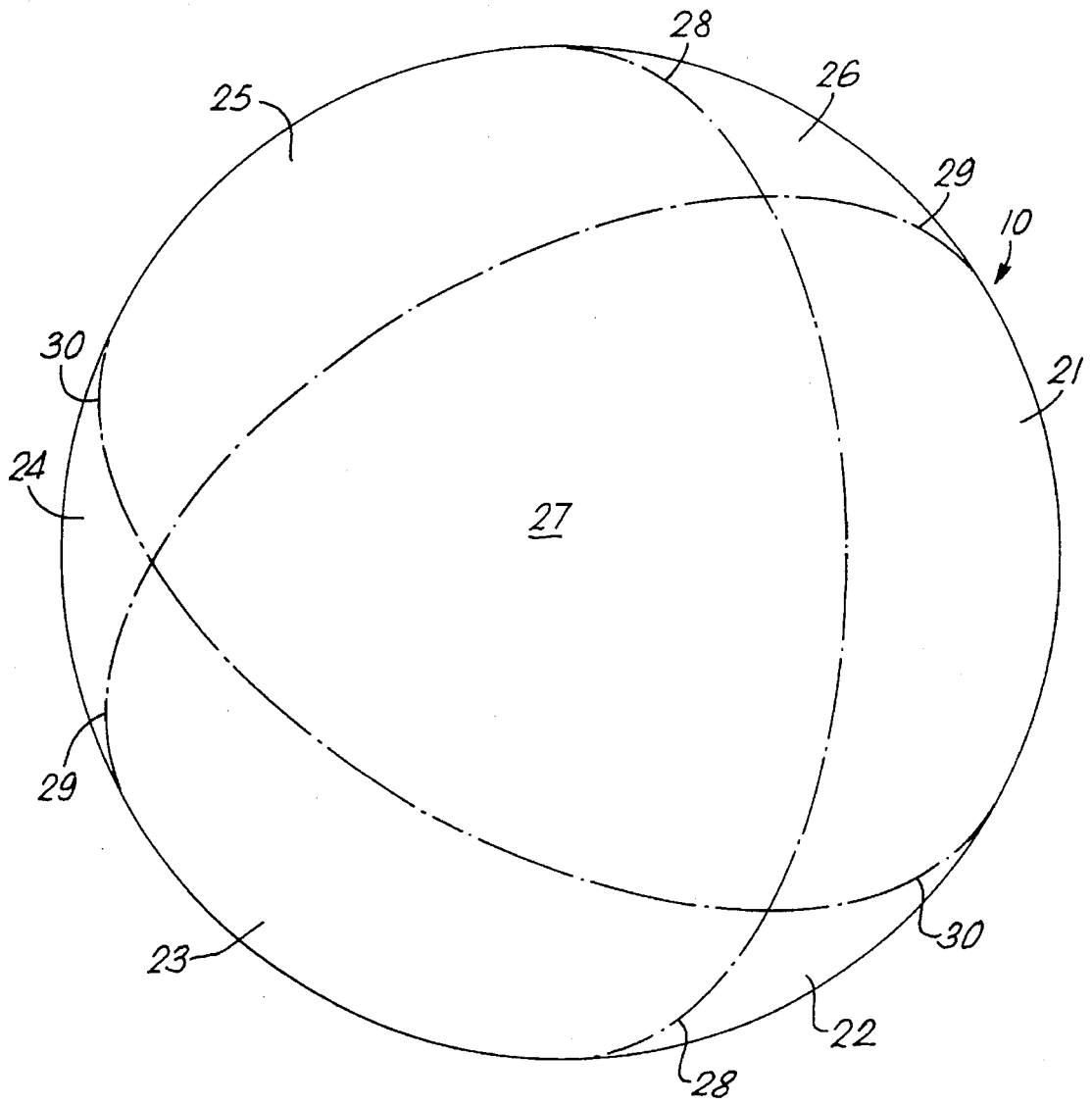
FIG. 1 is a view of part of a golf ball showing seven of the possible eight equilateral triangular faces of an inscribed regular octahedron.

In FIG. 1, a golf ball 10 is divided into eight equilateral triangles (seven are shown: 21, 22, 23, 24, 25, 26 and 27) by projection on to the surface of the ball of the edges of a regular octahedron. The edges of the octahedron may be projected onto the spherical surface of the ball by means such as in an imaginary manner or by drawing or inscribing a temporary line. (Nine of said edges are represented by chain-dotted lines 28, 29 and 30, which constitute three great circles of the ball).

Figure 2:
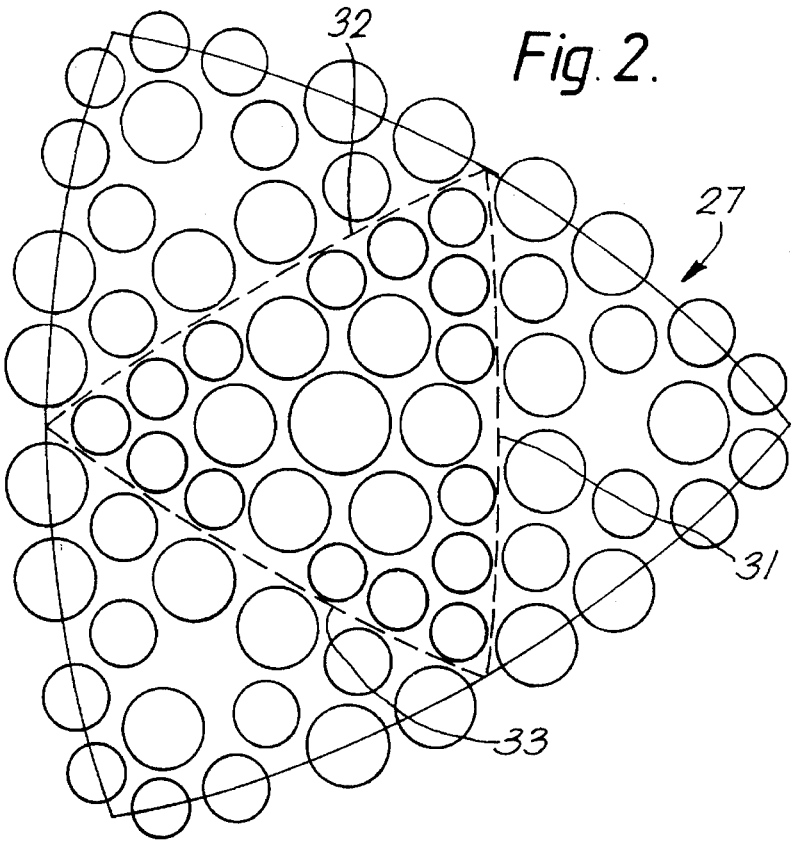
FIG. 2 is a view of one of the triangular faces of FIG. 1, sub-divided according to the first preferred embodiment of the present invention and showing a suitable dimple arrangement.
Figure 3:
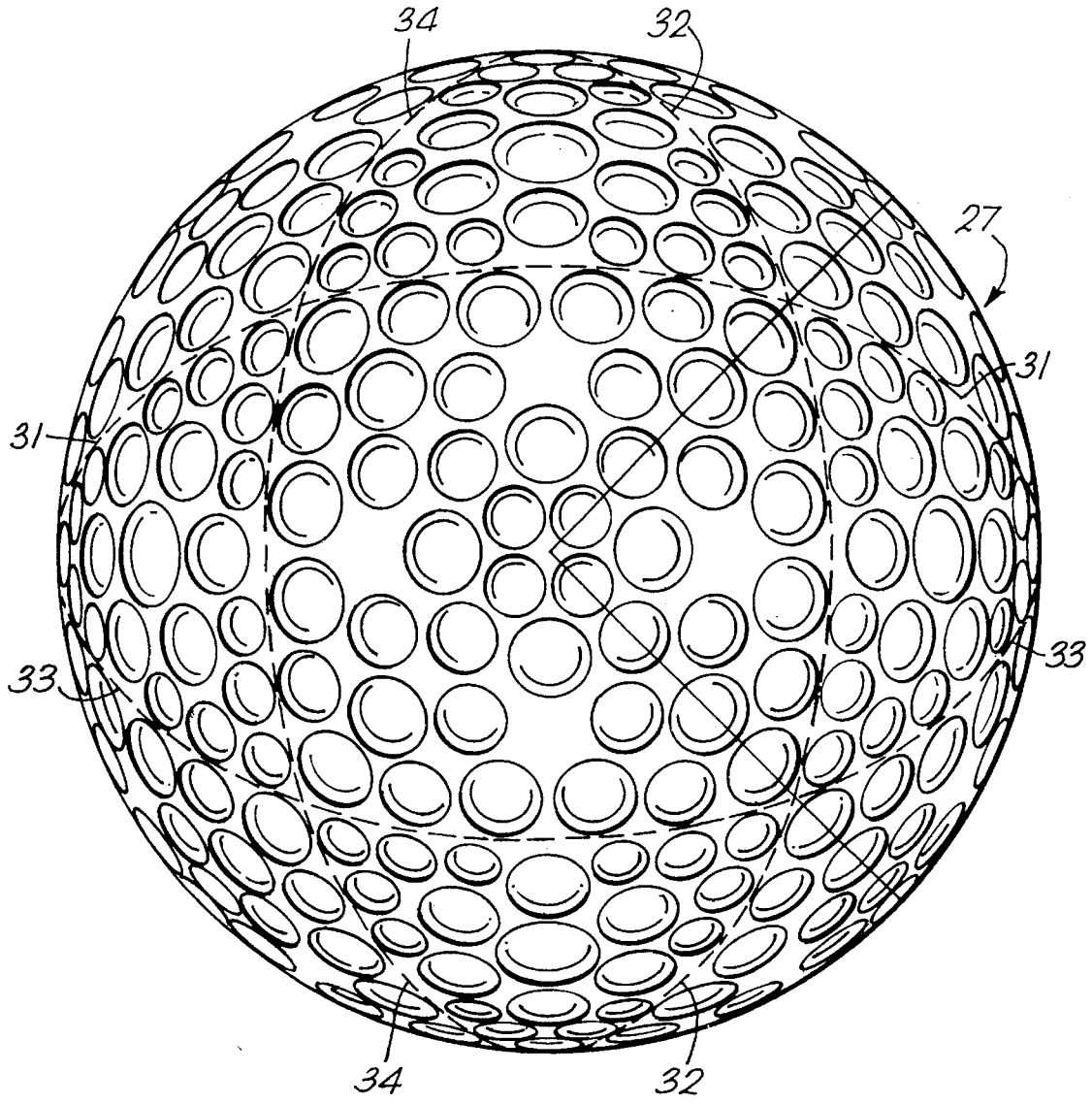
FIG. 3 is a view of part of the complete ball generated by FIG. 2.

In FIG. 2, the triangle 27 of FIG. 1 is shown, divided into four sub-triangles by means of great circular paths 31, 32 and 33 which join centre-side to centre-side of triangle 27. If the arrangement of FIG. 2 is extended over the whole surface of the ball (as shown in FIG. 3), this will produce a total of thirty-two triangles and four dimple-free great circles (indicated by broken lines 31, 32, 33 and 34).

Figure 4:
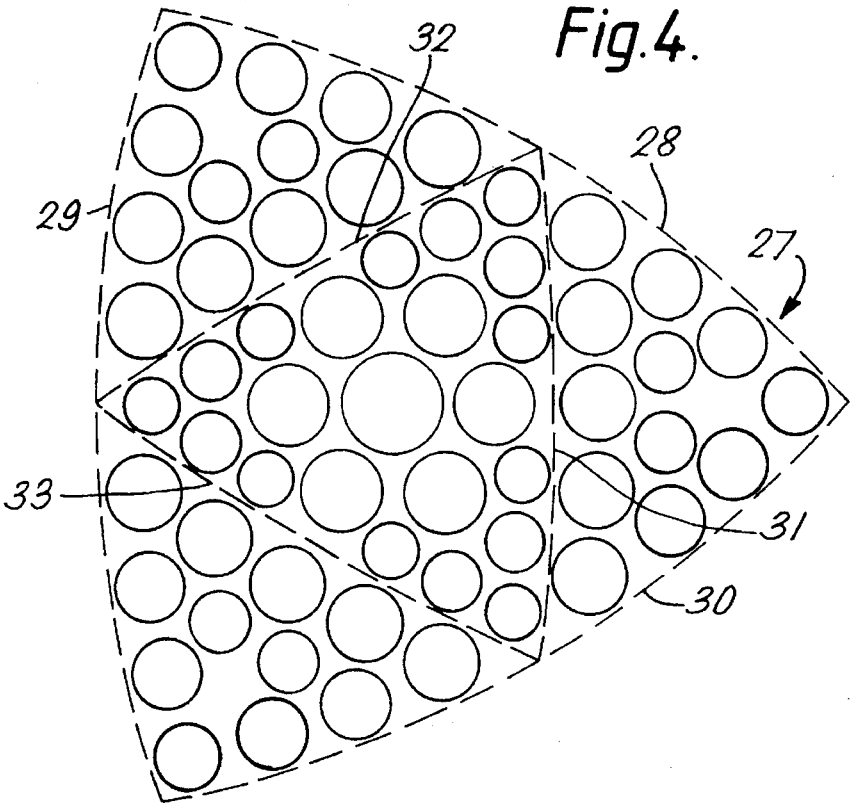
FIG. 4 is a view of the same triangular face of FIG. 1, sub-divided according to the second preferred embodiment of the present invention.
Figure 5:
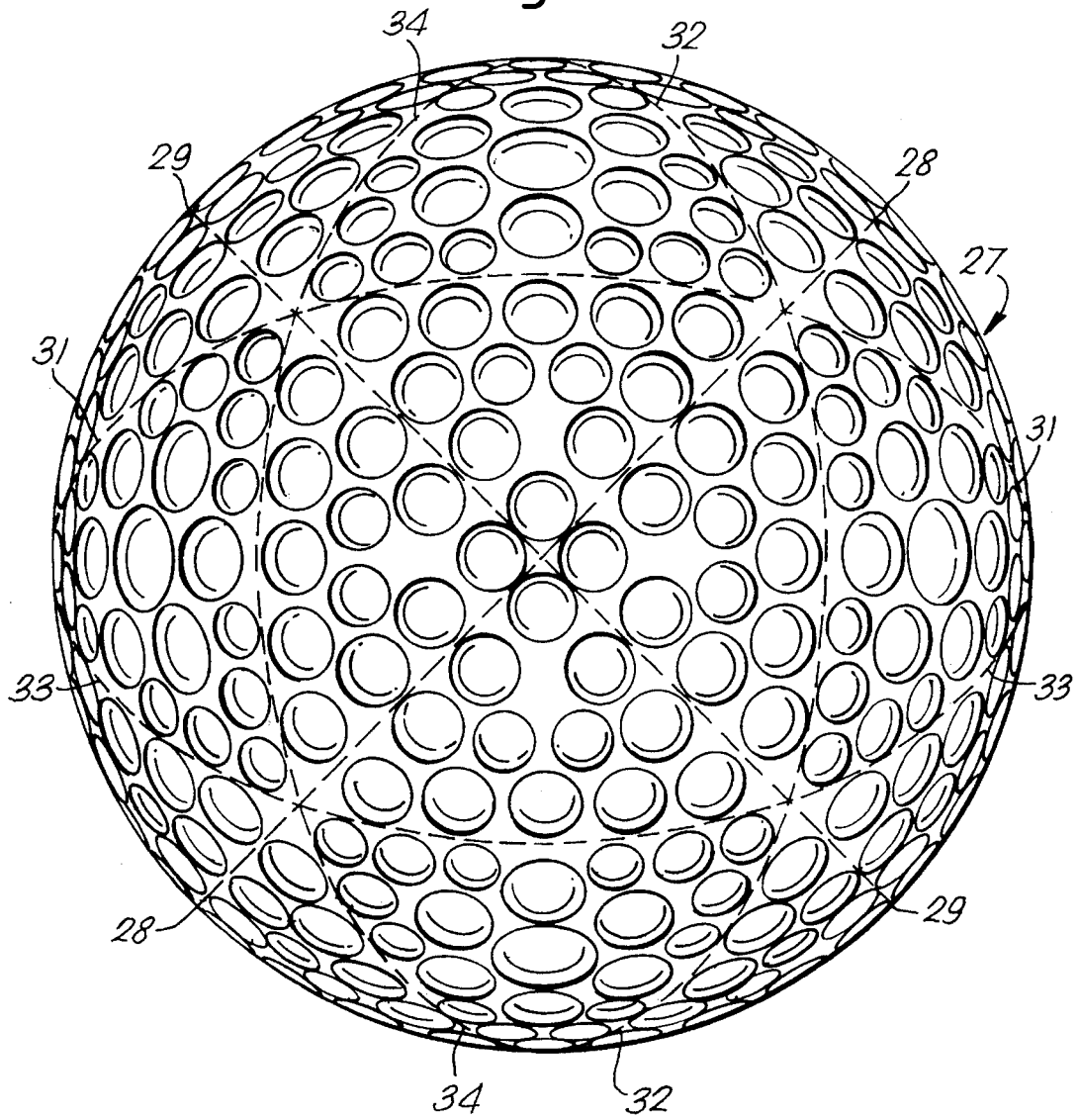
FIG. 5 is a view of part of the complete ball generated by FIG. 4.

In FIG. 4, the triangle 27 of FIG. 1 is again divided into four sub-triangles by great circular paths 31, 32 and 33 which join centre-side to centre-side of triangle 27. In addition, the three sides 28, 29 and 30 of triangle 27 also constitute great circular paths. If the arrangement of FIG. 4 is extended over the whole surface of the ball (as shown in FIG. 5), this will produce a total of forty triangles and seven dimple-free great circles (six of which are indicated by broken lines 28, 29, 31, 32, 33 and 34).

Figure 6:
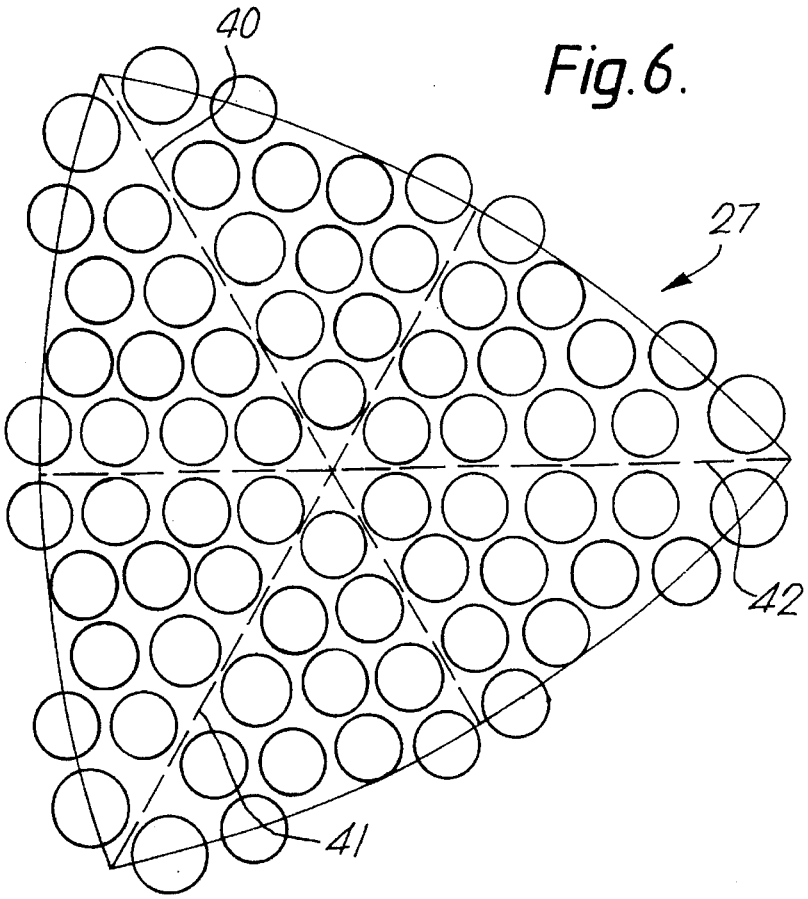
FIG. 6 is a view of the same triangular face of FIG. 1, sub-divided according to the third preferred embodiment of the present invention.
Figure 7:
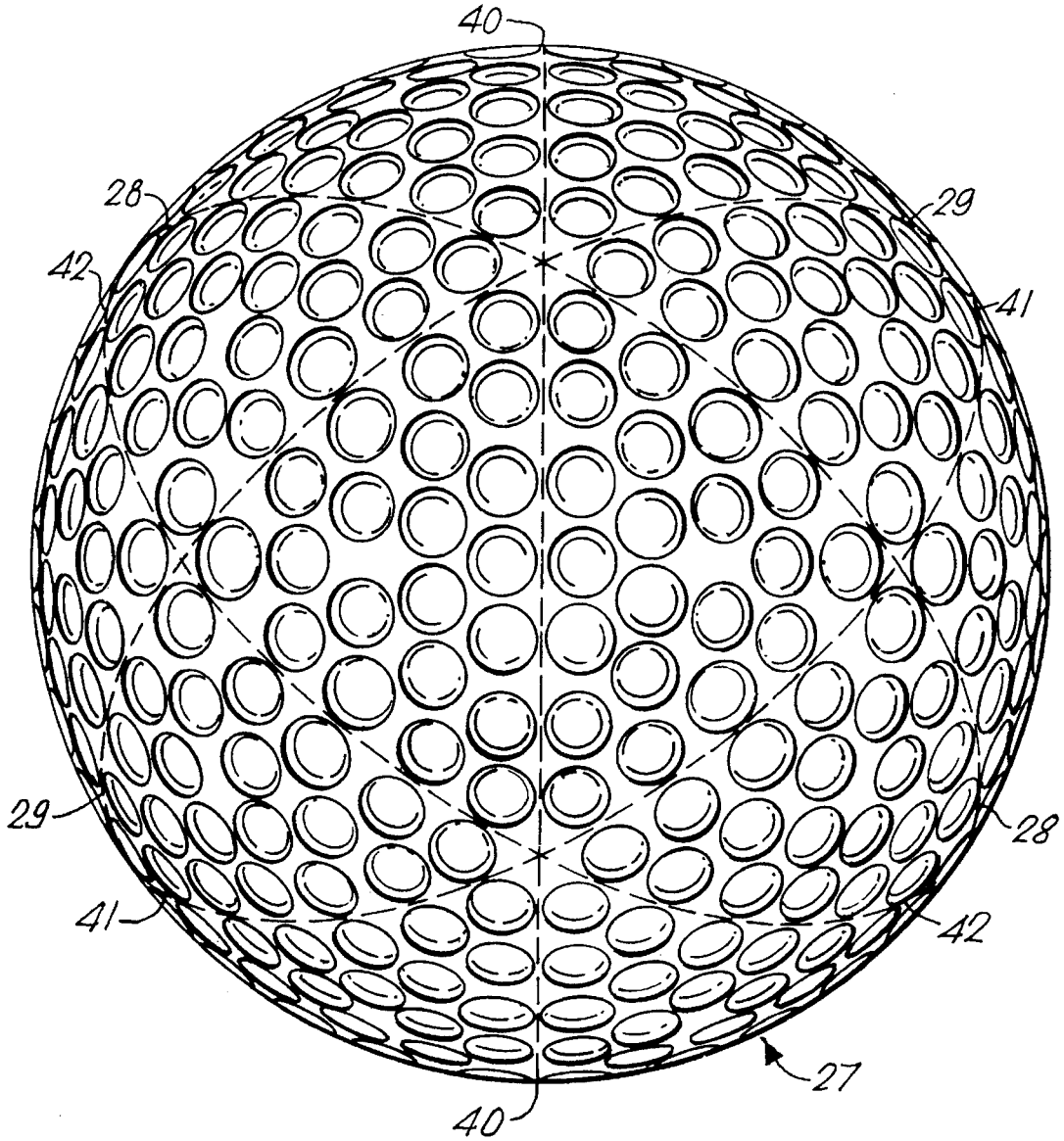
FIG. 7 is a view of part of the complete ball generated by FIG. 6.

In FIG. 6, the triangle 27 of FIG. 1 is shown, divided into three pairs of sub-triangles by means of great circular paths 40, 41 and 42 which join centre-side to opposite apex of triangle 27. If the arrangement of FIG. 6 is extended over the whole surface of the ball (as shown in FIG. 7), this will produce a total of forty-eight triangles and six dimple-free great circles (five of which are indicated by broken lines 28, 29, 40, 41 and 42).

Figure 8:
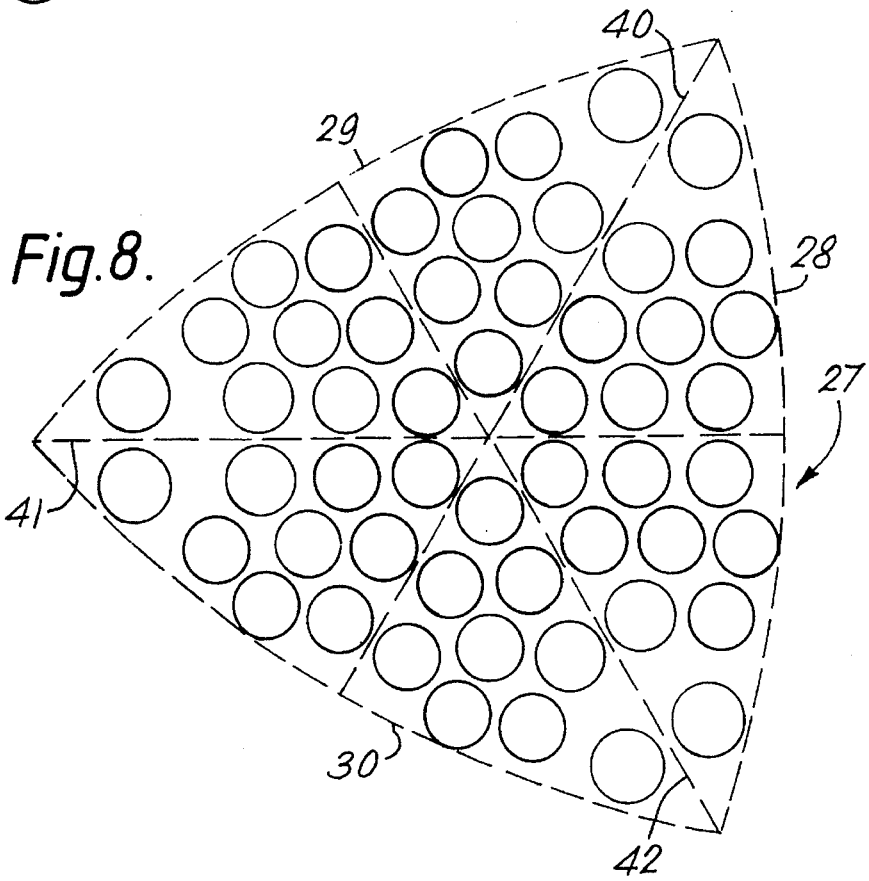
FIG. 8 is a view of the same triangular face of FIG. 1, sub-divided according to the fourth preferred embodiment of the present invention.
Figure 9:
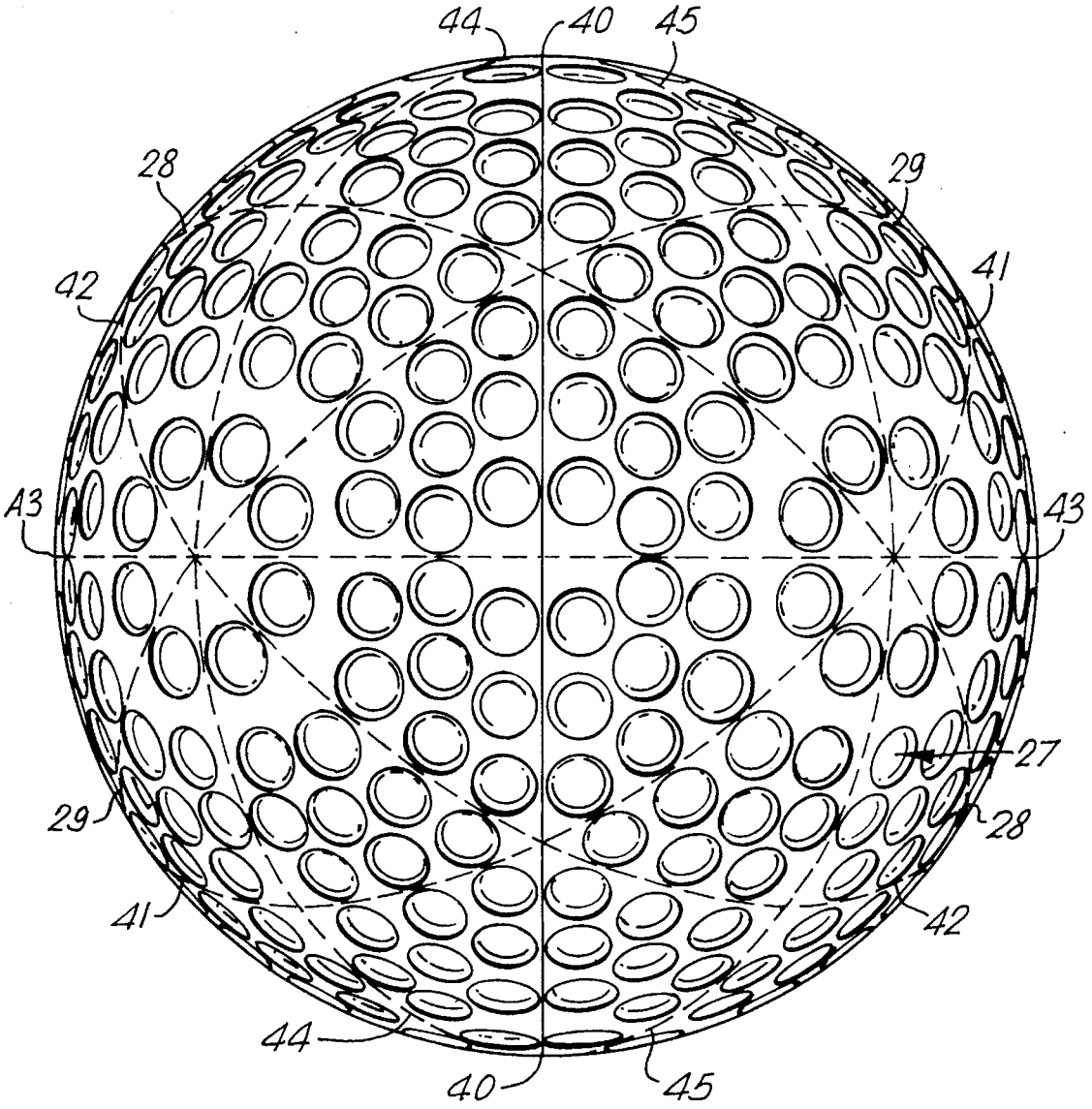
FIG. 9 is a view of part of the complete ball generated by FIG. 8.

In FIG. 8, the triangle 27 of FIG. 1 is again divided into three pairs of sub-triangles by great circular paths 40, 41 and 42 which join centre-side to opposite apex of triangle 27. In addition, the three sides 28, 29 and 30 of triangle 27 also constitute great circular paths. If the arrangement of FIG. 8 is extended over the whole surface of the ball (as shown in FIG. 9), this will produce a total of fifty-six triangles and nine dimple-free great circles (eight of which are indicated by broken lines 28, 29, 40, 41, 42, 43, 44 and 45).

We claim:

1. A dimpled golf ball having a spherical surface and in said spherical surface a various number of dimple-free great circles, said spherical surface having a dimple pattern arranged in eight equilateral triangles corresponding to the edges of a regular octahedron projected directly on the spherical surface, and each of said eight equilateral triangles being sub-divided by great circles into a various number of sub-triangles, whereby the total number of dimple-free great circles on the surface of the ball is six, seven or nine and the corresponding total number of triangular elements is forty-eight, forty or fifty-six, respectively.

2. The golf ball of claim 1 wherein each of said eight equilateral triangles of said octahedron is subdivided into three isoceles sub-triangles and one equilateral sub-triangle by means of dimple free great circular paths by joining centre-side to centre-side wherein additional dimple-free great circles are provided along each edge of said octahedron, making forty sub-triangles in all and creating seven dimple-free great circles on the surface of the ball.

3. The golf ball of claim 1, wherein each of said eight equilateral triangles of said octahedron is sub-divided into three pairs of sub-triangles by dimple-free great circular paths joining centre-side to opposite apex, making forty-eight sub-triangles in all and creating six dimple-free great circles on the surface of said ball.

4. The golf ball of claim 3, wherein additional dimple-free great circles are provided along each edge of said octahedron, making fifty-six sub-triangles in all and creating nine dimple-free great circles on the surface of said ball.

5. The golf ball of claim 1, wherein said ball is made in a mould having a parting line and one of said dimple-free great circles corresponds to said parting line of said mould.

6. The golf ball of claim 1, wherein the dimples in any one of said sub triangles are of uniform dimensions.

7. The golf ball of claim 1, wherein the dimples in any one of said sub-triangles are of at least two different dimensions.

8. The golf ball of claim 1, wherein at least 60% of the surface area of said ball is provided with dimples.

9. The golf ball of claim 1, said ball having in its spherical surface from about 200 to about 600 dimples.

10. The golf ball of claim 1, wherein the configuration of the dimples is symmetrical relative to the edges of the regular octahedron.

11. A method of producing dimple patterns on the spherical surface of a golf ball whereby a various number of dimple-free great circles is attainable from a single geometrical polyhedral projection, comprising: projecting the edges of a regular octahedron directly on the spherical surface to provide eight equilateral triangles defined by said edges, sub-dividing each of said eight equilateral triangles by means of great circular paths, and arranging dimples in a pattern defined by the sub-divided triangles, such that the total number of dimple-free great circles on the spherical surface is selected from six, seven and nine.

12. A method according to claim 11, in which each of the eight equilateral triangles of the octahedron is sub-divided into three isosceles sub-triangles and one equilateral sub-triangle by means of dimple-free great circular paths joining center-side to center-side and creating additional dimple-free great circles along each edge of the octahedron, making forty triangles in all and creating a total of seven dimple-free great circles on the spherical surface of the ball.

13. A method according to claim 11, in which each of the eight equilateral triangles of the octahedron is sub-divided into three pairs of sub-triangles by means of dimple-free great circular paths joining center-side to opposite apex, making forty-eight triangles in all and creating a total of six dimple-free great circles on the spherical surface of the ball.

14. A method according to claim 13, in which additional dimple-free great circles are created along each edge of the octahedron, making fifty-six triangles in all and creating a total of nine dimple-free great circles on the spherical surface of the ball.

15. A method according to claim 11, in which the ball is made by molding and one of the dimple-free great circles corresponds to the parting line of the mold.

16. The method of producing dimple patterns on the spherical surface of a golf ball of claim 11 wherein the dimples in any one of the subtriangles are of uniform dimensions.

17. The method of producing dimple patterns on the spherical surface of a golf ball of claim 11 wherein the dimples in any one of the subtriangles are of two or more different dimensions.

18. The method of producing dimple patterns on the spherical surface of a golf ball of claim 11 wherein at least sixty per cent of the surface of the ball is provided with dimples.

19. The method of producing dimple patterns on the spherical surface of a golf ball of claim 11 wherein the ball has in its spherical surface between approximately 200 and 600 dimples.

* * * * *